US009745764B2

(12) United States Patent
Fisher

(10) Patent No.: US 9,745,764 B2
(45) Date of Patent: Aug. 29, 2017

(54) METHODS AND DEVICES FOR MODULAR CONSTRUCTION

(71) Applicant: John Sergio Fisher, Tarzana, CA (US)

(72) Inventor: John Sergio Fisher, Tarzana, CA (US)

( * ) Notice: Subject to any disclaimer, the term of this patent is extended or adjusted under 35 U.S.C. 154(b) by 0 days.

(21) Appl. No.: 15/264,298

(22) Filed: Sep. 13, 2016

(65) Prior Publication Data

US 2017/0073957 A1 Mar. 16, 2017

Related U.S. Application Data

(60) Provisional application No. 62/218,472, filed on Sep. 14, 2015.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 1/348*** | (2006.01) |
| *E04B 1/04* | (2006.01) |

(52) U.S. Cl.

CPC ..... *E04H 1/005* (2013.01); *E04B 1/34823* (2013.01); *E04B 1/043* (2013.01); *E04B 2001/34892* (2013.01)

(58) Field of Classification Search

CPC .. E04H 1/005; E04H 1/04; E04H 1/00; E04B 1/348; E04B 1/34823; E04B 1/043; E04B 2001/34892; E04G 11/02

See application file for complete search history.

(56) References Cited

U.S. PATENT DOCUMENTS

| | | | | |
|---|---|---|---|---|
| 2,259,783 | A * | 10/1941 | Sparling | E04B 1/3442 446/478 |
| 4,194,339 | A | 3/1980 | Fisher | |
| 4,228,623 | A | 10/1980 | Menosso | |
| 6,393,774 | B1 | 5/2002 | Fisher | |
| 6,493,996 | B1 | 12/2002 | Alexander et al. | |
| 7,549,255 | B2 * | 6/2009 | Kirkwood | A47B 43/00 52/66 |
| 8,082,699 | B1 | 12/2011 | Kychelhahn | |
| 2010/0287848 | A1 | 11/2010 | Pepin | |
| 2013/0232887 | A1 * | 9/2013 | Donnini | E04B 1/3442 52/79.5 |
| 2016/0032601 | A1 * | 2/2016 | McCaffrey | E04B 1/34823 264/34 |

OTHER PUBLICATIONS

International Search Report dated Dec. 28, 2016 from PCT Application No. PCT/US2016/051541.

* cited by examiner

*Primary Examiner* — Brian Mattei

(74) *Attorney, Agent, or Firm* — K. David Crockett, Esq.; Paul J. Backofen, Esq.; Crockett & Crockett, PC

(57) ABSTRACT

A 3-dimensional modular construction system using only two, generally U-shaped prefabricated room size modules is used to form scalable, modular construction for schools, apartments, hotels, houses and the like. The modules may be formed of reinforced concrete. By using the above described modules, double walls within the buildings are eliminated thus, simplifying construction and reducing material and costs, while becoming a container for the pre-finishing of the spaces.

9 Claims, 7 Drawing Sheets

METHODS AND DEVICES FOR MODULAR CONSTRUCTION

RELATED APPLICATIONS

This application claims priority to U.S. Provisional Patent Application 62/218,472 filed Sep. 14, 2015.

FIELD OF THE INVENTIONS

The inventions described below relate to the field of modular building construction systems.

BACKGROUND OF THE INVENTIONS

In conventional modular construction there is often a conflict between the need to provide flexible designs and a resulting redundancy of walls (double walls). That shortcoming consisted of having two bearing walls side-by-side results from the necessities and constraints of the system, particularly when the material is reinforced concrete. 3-dimensional "U" shaped (in vertical cross-section) modules are vertically cast. Therefore module can only have a maximum length in any dimension of about 3.7 meters (12 feet). Dropping the concrete any further during pre-cast pouring will cause separation of aggregate from the cement. Fisher, Method for Constructing Town Houses and the Like, U.S. Pat. No. 4,194,339 (Mar. 25, 1980) dramatizes the problem of the double walls which create more material and more cost. The challenge is to develop a system that allows for parallel bearing walls that eliminates the double walls and also eliminates the use of the "L" shaped module illustrated in Fisher, Construction System for Modular Apartments, Hotels and the Like, U.S. Pat. No. 6,393,774 (May 28, 2002) which has turned out to be physically cumbersome and therefore more expensive.

SUMMARY

The devices and methods described below provide for a 3-dimensional modular construction system, using only two, generally U-shaped prefabricated room size modules, construction modules, to form scalable, modular construction for schools, apartments, hotels, houses and the like. The modules may be formed of reinforced concrete. By using the above described construction modules, double walls within the buildings are eliminated, thus simplifying construction and reducing material and costs. The construction modules operate as containers for the pre-finishing of the spaces. Electrical conduits are embedded in the precast modules while plumbing and air conditioning lines are furred out from the concrete walls.

An end module is formed of a floor, an end wall and an interior wall. The floor has a length and a first edge between first and second corners, a second edge between third and fourth corners, a width and a centerline between the first and second corners and between the third and fourth corners. The end wall has a width corresponding to the width of the floor and also having a height, the end wall integrally formed with the first edge of the floor. The interior wall has a height corresponding to the height of the end wall, the interior wall integrally formed with the second edge of the floor between the centerline and fourth corner and parallel to the end wall, the interior wall having a width equal to half of the width of the floor.

An interior module is formed of a floor and a first and second wall where the first and second walls are half walls.

The floor has a length and a first edge between first and second corners, a second edge between third and fourth corners, a width and a centerline equidistant between the first and second corners and equidistant between the third and fourth corners. The first interior wall has a height corresponding to the height of the end wall of the end module, the interior wall integrally formed with the first edge of the floor between the centerline and the second corner, the end wall having a width corresponding to half of the width of the floor. The second interior wall has a height corresponding to the height of the end wall of the end module, the second interior wall integrally formed with the second edge of the interior module floor between the centerline and fourth corner and parallel to the first interior wall, the second interior wall having a width equal to half of the width of the floor. Any suitable number of end modules and interior modules may be combined to form a 3-dimensional, scalable plurality of rooms.

DETAILED DESCRIPTION OF THE INVENTIONS

Figure 1:
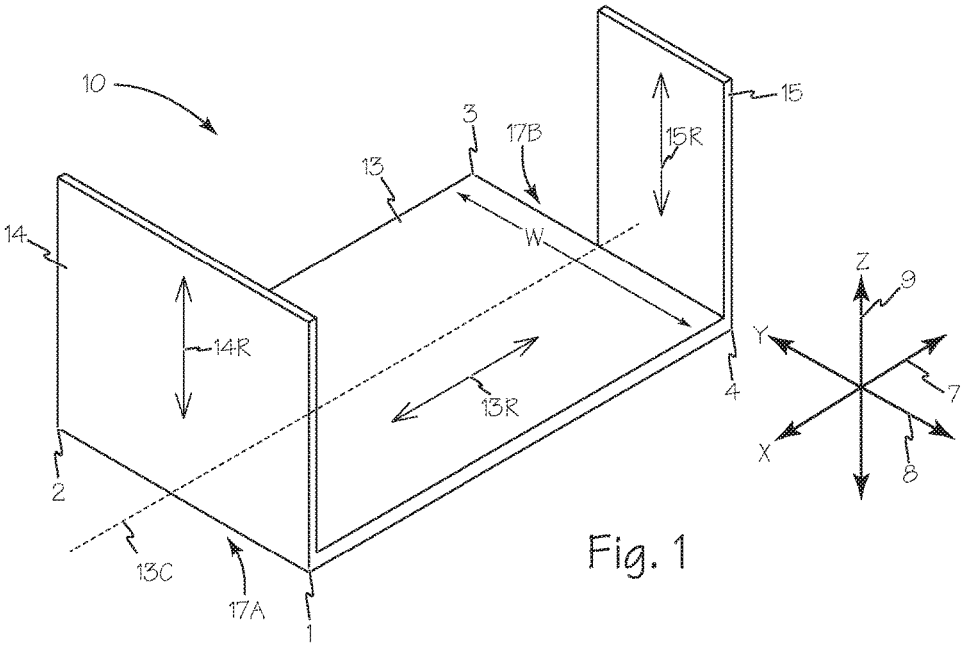
FIG. 1 illustrates a perspective view of an end module forming a portion of a room.
Figure 2:
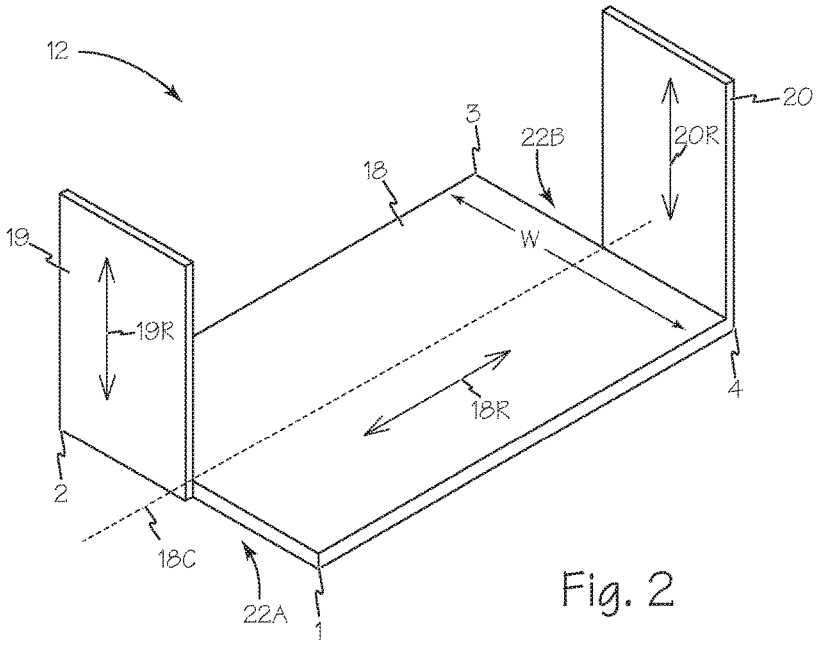
FIG. 2 illustrates a perspective view of a central module forming a portion of a room.

FIGS. 1 and 2 illustrate end module 10 and central module 12 that form portions of rooms for assembling scalable modular rooms side by side that avoids the problem of having redundant walls. Sidewalls and roof modules, panels and or diaphragms may be added using any suitable conventional technique.

End module 10 includes floor 13, end wall 14 and interior wall 15. Length of the module and its elements is measured parallel to X-axis 7, width is measured parallel to Y-axis 8 and height is measured parallel to Z-axis 9. Floor 13 is rectangular and corners 1, 2, 3 and 4 oriented clockwise around the X-Y plane of the floor and the floor has a first end or edge 17A between corners 1 and 2 and a second end or edge 17B between corners 3 and 4. End wall 14 is a full wall and is integrated with the floor at first edge 17A between corners 1 and 2 and has width W corresponding to the width of the floor and height H. Interior wall 15 is a half-wall and is integrated with the floor at second edge 17B between floor centerline 13C and corner 4 and has width W/2. Floor 13, end wall 14 and interior wall 15 are cast with integral reinforcing steel oriented parallel to the reinforcement axes 13R, 14R and 15R respectively. Where the steel reinforcement is formed by welded wire fabric, the longitudinal wires of the welded wire fabric are oriented parallel to the reinforcement axes. End wall 14 and interior wall 15 are load bearing and transmit their loads to the wall they are oriented above or directly to the foundation stem wall if they are first floor modules. End module 10 may be rotated in the X-Y plane to form both ends of a row of room portions.

Central module 12 includes floor 18, first wall 19 and second wall 20. Floor 18 has width W, corners 1, 2, 3 and 4 oriented clockwise around the X-Y plane of the floor and first edge 22A between corners 1 and 2 and second edge 22B between corners 3 and 4. First wall 19 is a half-wall with width W/2 and is integrated to the first edge 22A of floor 18 between floor centerline 18C and corner 2. Second wall 20 is a half-wall with width W/2 and is integrated to the second edge 22B of floor 18 between floor centerline 18C and corner 4. Floor 18, first wall 19 and second wall 20 are cast with integral reinforcing steel oriented parallel to the reinforcement axes 18R, 19R and 20R respectively. Where the steel reinforcement is formed by welded wire fabric, the longitudinal wires are oriented parallel to the reinforcement axes. First wall 19 and second wall 20 are load bearing and transmit their loads to the wall they are oriented above or directly to the foundation stem wall if they are first floor modules.

Figure 3:
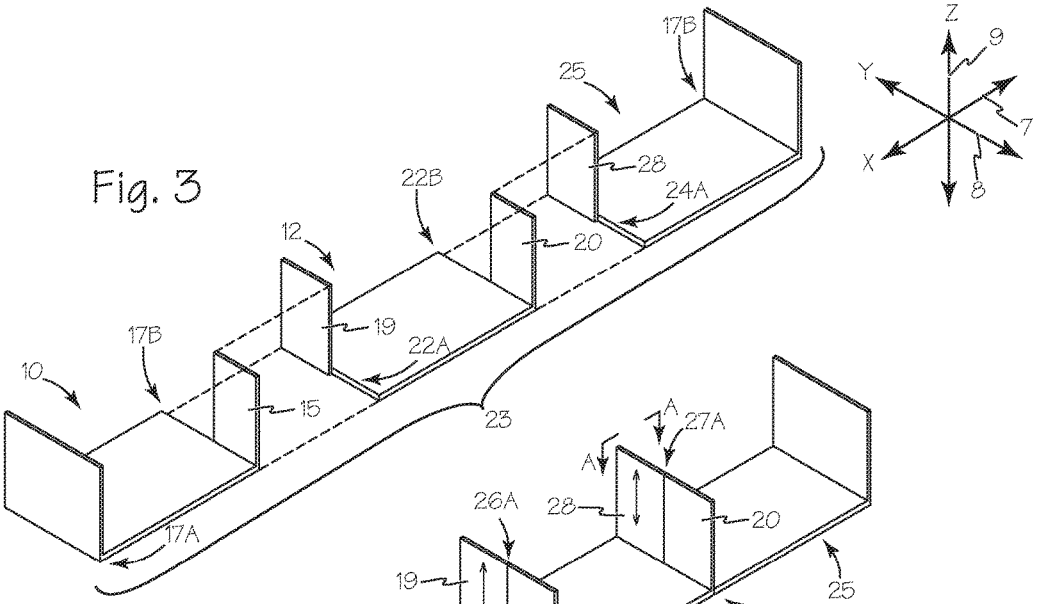
FIG. 3 illustrates an exploded isometric of the building elements of FIGS. 1 & 2 combined to form a row of room portions.

FIG. 3 illustrates an exploded isometric of the building elements of FIGS. 1 & 2 combined to form a row of room portions, row 23. End module 25 is a copy of end module 10 rotated 180° about Z-axis 9. Second edge 17B of end module 10 engages first edge 22A of central module 12. Second edge 22B central module 12 engages first edge 24A of end module 25. There is no limit to the length of a row of room portions that may be formed by using as many central modules as necessary between two end modules as in row 23.

Figure 4:
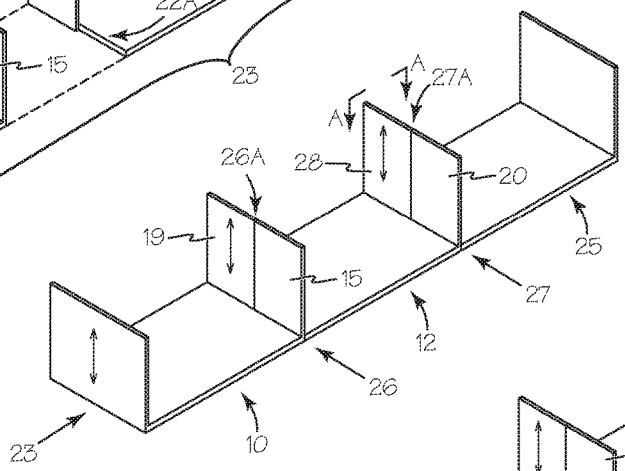
FIG. 4 illustrates the elements of FIG. 3 engaged together to form a row of 3 side-by-side room portions with no double walls.

FIG. 4 illustrates the modules of FIG. 3 fully engaged to form row 23 of room portions. Second edge 17B of end module 10 engages first edge 22A of central module 12 at interface 26. Interior wall 15 and first wall 19 combine to form a complete wall extending the full width of the floor at interface 26 with seam 26A between the wall portions. Second edge 22B of central module 12 engages first edge 24A of end module 25 at interface 27. Interior wall 28 and second wall 20 combine to form a complete wall extending the full width of the floor at interface 27 with seam 27A between the wall portions.

Figure 5:
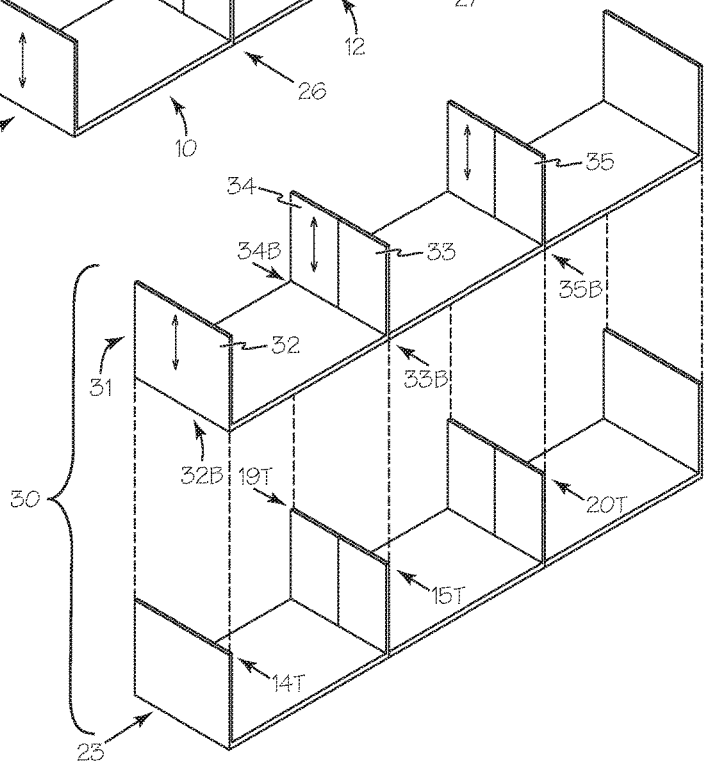
FIG. 5 illustrates several rows of room portions as in FIG. 4 stacked in multiple stories to create a plane of room portions.

FIG. 5 illustrates several rows of room portions as shown in FIG. 4, stacked in multiple stories to create a stack of room portions 30. Row 23 forms the first floor of stack 30. A second row of room portions, row 31 is stacked on row 23 with the end walls and wall portions of row 31 aligned with the end walls and wall portions of row 23 respectively. The top edges of the end walls and wall portions of row 23 engage the bottom edges of the end walls and wall portions of row 31 such as top edge 14T of end wall 14 engaging and supporting bottom edge 32B of end wall 32, top edge 15 of interior wall 15 engaging and supporting bottom edge 33B of interior wall 33, top edge 19T of first wall 19 engaging and supporting bottom edge 34B of first wall 34 and top edge 20 of second wall 20 engaging and supporting bottom edge 35B of second wall for example.

Figure 6:
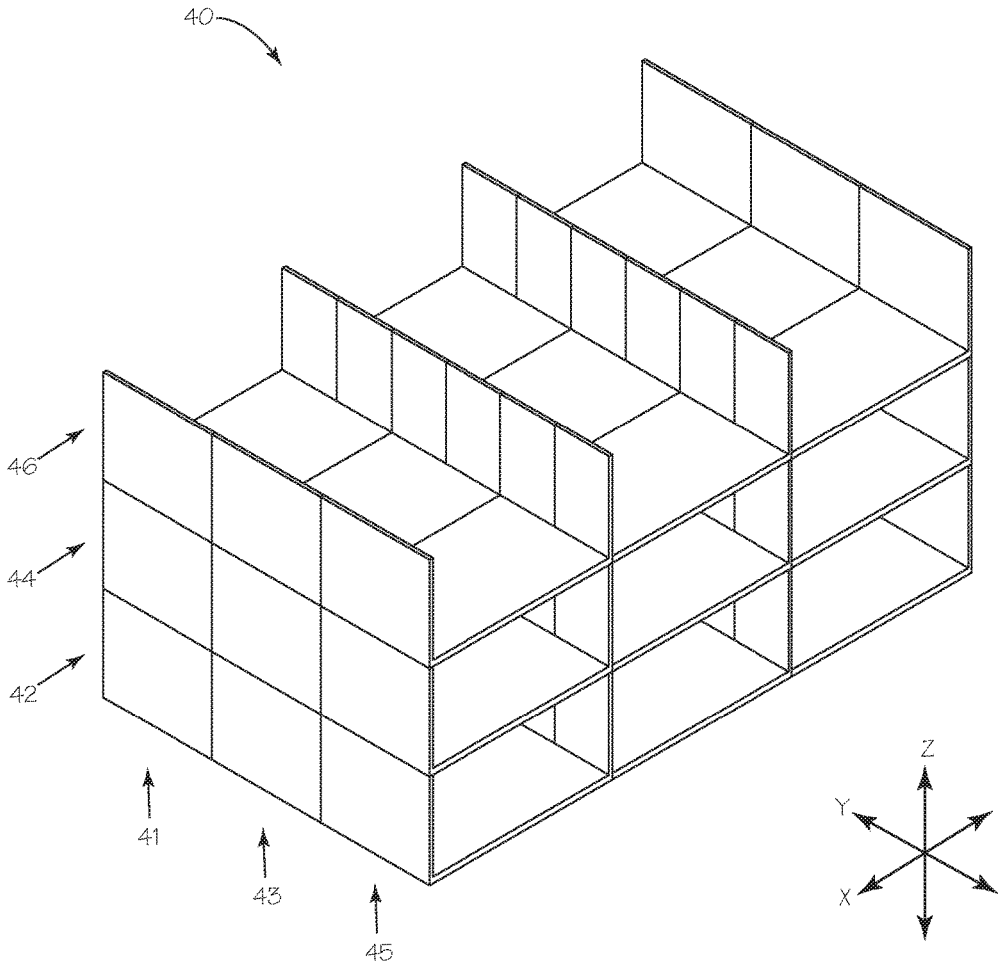
FIG. 6 illustrates 3 floors of room portions as in FIG. 4 forming a first stack of room portions which is repeated 2 more times to create an array of typically sized rooms.

FIG. 6 illustrates building portion 40 which has three stacks of 3 floors of room portions to create an array of typically sized rooms. First stack of room portions, stack 41 is composed of three rows of room portions, first row 42, second row 44 and third row 46. First row 42 supports second row 44 which in turn supports third row 46 as discussed above with respect to FIG. 5. Additional stacks of room portions such as second stack 43 and third stack 45 are aligned together with the end modules of adjacent stacks aligned adjacent to each other and central modules of adjacent stacks aligned adjacent to each other. Building portion 40 may be formed of as many rows, stacks and room portions as necessary.

Figure 7:
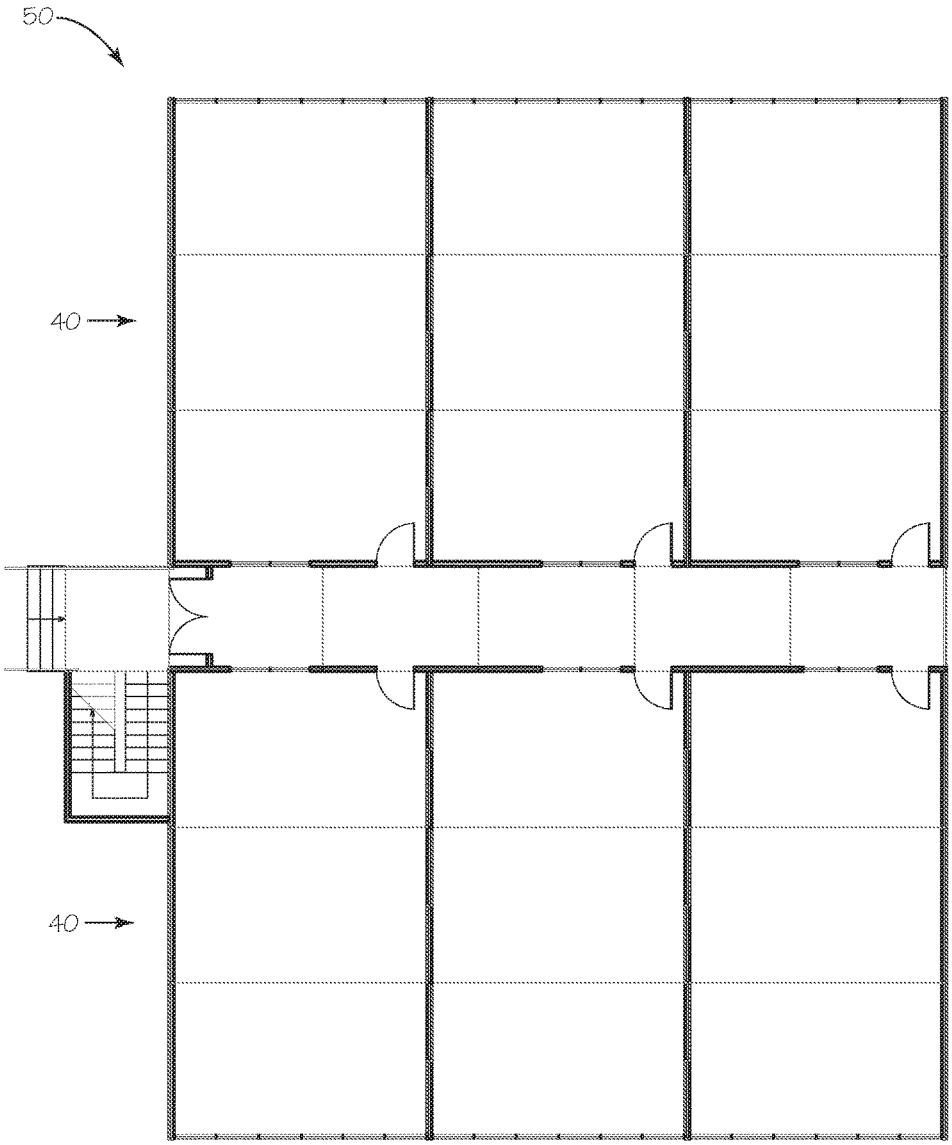
FIG. 7 is a plan view showing the configuration in FIG. 6 mirrored about a corridor with an exit stair.
Figure 8:
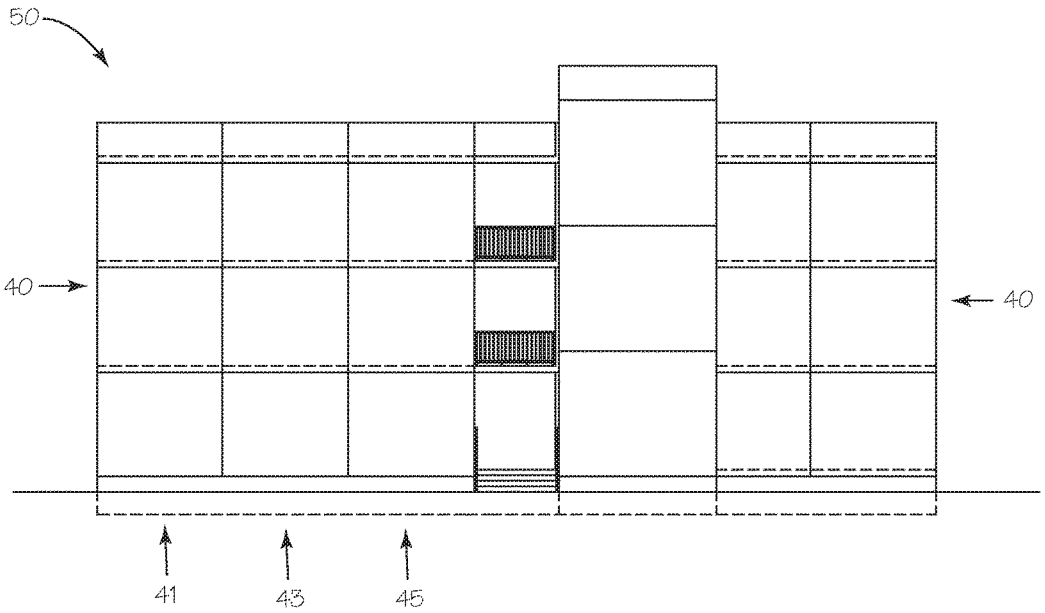
FIG. 8 illustrates a side elevation of the 18-room building of the plan of FIG. 7.
Figure 9:
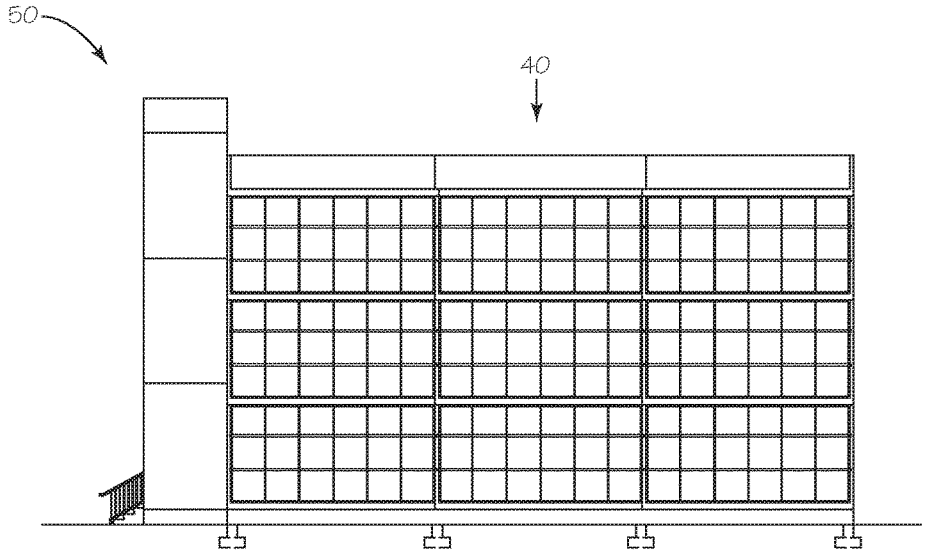
FIG. 9 illustrates the end-glazed elevation of the plan of FIG. 7.

FIG. 7 is a plan view of building 50 which is formed of two instances of building portion 40 of FIG. 6 mirrored about a corridor with an exit stair. FIG. 8 illustrates a side elevation of building 50 and FIG. 9 shows the end-glazed elevation of building 50.

Figure 10:
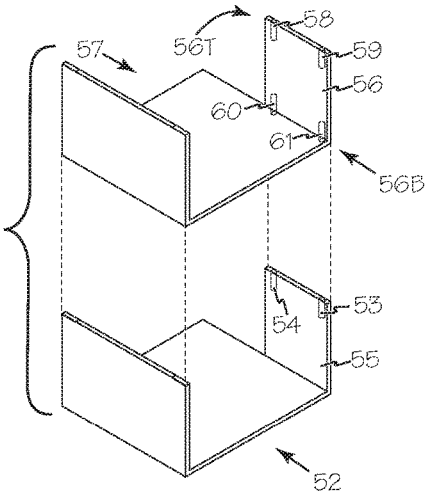
FIG. 10 is a close up view illustrating the steel insert couplers in the modular elements.

Modular construction as discussed may use any suitable technique for securing the modules together and transferring loads between modules. Vertical components such as half walls and end walls may be secured to walls above and below using embedded couplers in the walls. FIG. 10 is a perspective view of two end modules illustrating the steel insert couplers in the half-walls. Ground floor end module 52 includes at least two couplers such as couplers 53 and 54 in top edge 55T of interior wall 55. Suitable connectors such as couplers 53 and 54 may be embedded in the top or bottom edge of any end wall or interior wall of an end module or any half walls of a central module. Interior wall 56 of end module 57 includes couplers 58 and 59 in top edge 56T and couplers 60 and 61 in bottom edge 56B of interior wall 56. In use, coupler 54 is secured to coupler 60 and coupler 53 is secured to coupler 61 to secure the bottom edge of interior wall 56 to top edge of interior wall 55.

Figure 11:
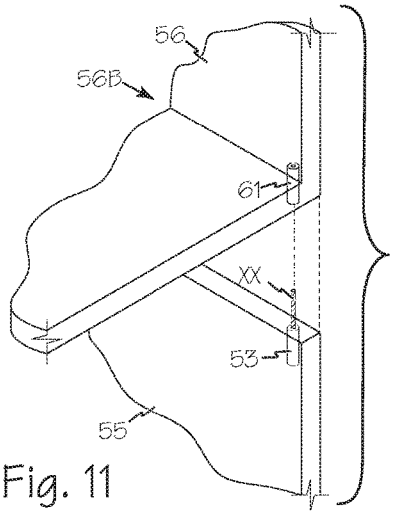
FIG. 11 is an isometric view illustrating the steel insert coupler.

FIG. 11 is a close-up, isometric view illustrating the coupler 53 with pin 62 ready to insert pin 62 into coupler 61 to securely engage the bottom edge 56B of interior wall 56 to top edge 55T of interior wall 55 to transfer building loads.

Figure 12:
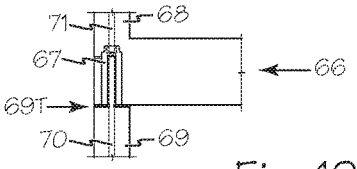
FIGS. 12 and 13 are cross-sections illustrating alternate module coupling connections.
Figure 13:
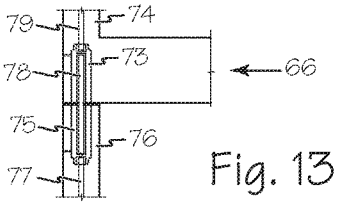

FIGS. 12 and 13 are cross-section views illustrating alternate module coupling connections. In FIG. 12, upper module 66 has coupler 67 cast in the bottom edge of wall 68. Wall 69 does not include a coupler. In this case, reinforcing element 70 extends from top edge of wall 69 and engages coupler 67 to secure the connection between the modules. Reinforcing elements within wall 68 such as reinforcing bar 71 are secured to coupler 67.

In FIG. 13, upper module 72 has coupler 73 cast in the bottom edge of wall 74. Coupler 75 is embedded into the top edge of wall 76 as discussed with respect to FIGS. 10 and 11. In this case, reinforcing element 77 engages coupler 75 and pin 78 engages both couplers 73 and 75 to secure the connection between the modules. Reinforcing elements within wall 74 such as reinforcing element 79 are secured to coupler 73.

Figure 14:
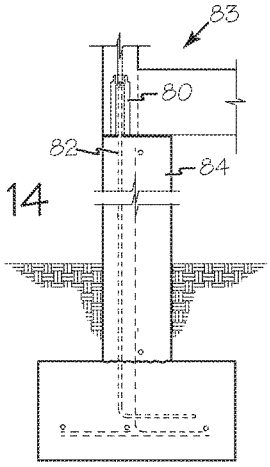
FIG. 14 shows the coupler connection of a module to a perimeter foundation stem wall.
Figure 15:
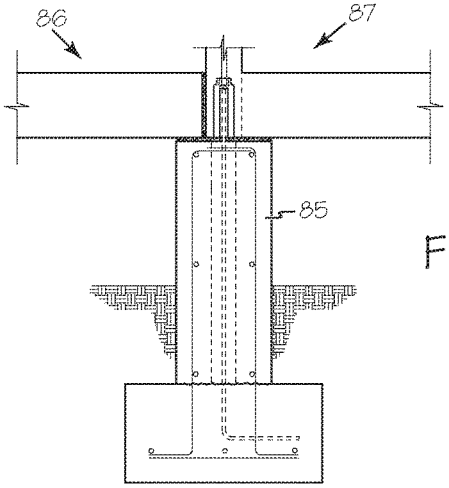
FIG. 15 shows an interior foundation stem wall supporting adjacent modules.

Couplers such as couplers 80 of FIG. 14 and coupler 81 of FIG. 15 may be used to secure the construction modules as discussed above to a perimeter stem wall or an interior stem wall respectively. FIG. 14 illustrates coupler 80 engaging foundation reinforcing element 82 connection of module 83 to perimeter foundation stem wall 84. FIG. 15 illustrates interior foundation stem wall 85 supporting adjacent modules, interior modules 86 and 87.

Figure 16:
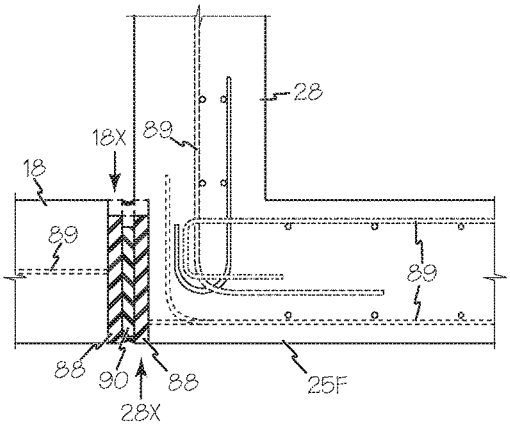
FIG. 16 is a cross-section illustration of a horizontal welded plate connection taken along A-A of FIG. 4.
Figure 17:
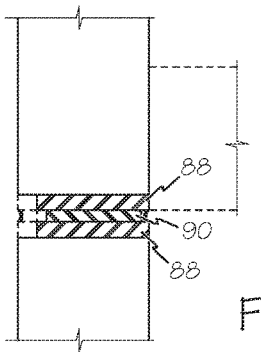
FIG. 17 is a cross-section illustration of a vertical welded plate connection of slab edges or wall edges where access is possible.

As an alternative, or in addition, to couplers cast into the vertical walls, flat plates or angle components may be cast into the walls and floors of end modules and central modules to enable horizontal as well as vertical attachment between modules. FIGS. 16 and 17 are cross-section illustrations of welded plate connection of slab edges or wall edges where access is possible. FIG. 16 is a cross section taken along A-A of FIG. 4 illustrating the attachment between floor 18 of central module 12 and the joint between interior wall 28 and floor 25F of end module 25. Joint plates 88 are welded to the reinforcing elements used in the modules such as reinforcing bars or welded wire fabric 89. The modules are cast with the welded wire fabric embedded into the module walls and floor and leaving joint plates exposed at floor edge 18X and wall edge 28X. Weld plate 90 is oriented between joint plates 88 and is welded to the adjacent joint plates to secure adjacent modules together.

Similarly, joint plates may be embedded into horizontal edges of the construction modules as illustrated in FIG. 17. Joint plates 88 are cast into the top and bottom surfaces of construction modules such as end module 10 and central module 12. As discussed above, weld plate 90 is oriented between joint plates 88 and is welded to the adjacent joint plates to secure adjacent modules together. Any suitable number of joint plates and weld plates may be used to secure the walls and floors of adjacent construction modules to comply with local building codes.

Figure 18:
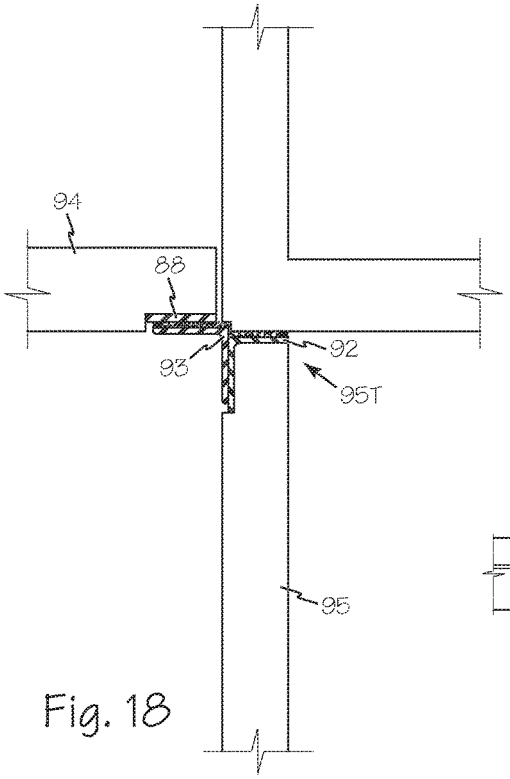
FIG. 18 illustrates an alternate connection between stacked and adjacent modules

FIG. 18 illustrates another alternate connection between stacked and adjacent modules. A combination of joint plates such as joint plate 88 and angle plates such as angle plate 92 are embedded into horizontal and vertical edges of the end modules and central modules. When the modules are properly oriented during installation, angled welding plates such as angled welding plate 93 are welded between adjacent module elements such as floor 94 and wall top 95T.

Figure 19:
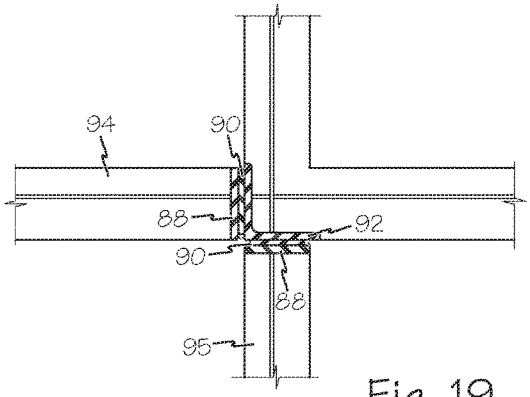
FIG. 19 illustrates the same module arrangements as FIG. 18 with all steel angles and plates are cast in the factory and then welded at the corners making the connections less visible.

FIG. 19 has the same module arrangements as FIG. 18 but steel angle 92 and joint plates 88 are cast in the factory and then welded together using weld plates 90 at the corners making the connections less visible.

If there is plumbing involved on either a half wall such as interior wall 15 or in a full wall such as end wall 14 then a prefabricated plumbing tree will be strapped to the walls between metal studs. Polyurethane spray will then cover the pipes and the space between metal studs and a suitable cement board will be adhered to the outside face of the metal studs. However electrical conduits are cast into the walls. Wiring, plumbing fixtures, cabinets, air conditioning units, doors, windows and tile are all installed in the modules in the factory.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. Manufactured components for modular building construction comprising:

an end module comprising:

a floor having a length and a first edge between first and second corners, a second edge between third and fourth corners, a width and a centerline between the first and second corners and between the third and fourth corners;

an end wall having a width corresponding to the width of the floor and also having a height, the end wall integrally formed with the first edge of the floor;

an interior wall having a height corresponding to the height of the end wall, the interior wall integrally formed with the second edge of the floor between the centerline and fourth corner and parallel to the end wall, the interior wall having a width equal to half of the width of the floor; and an interior module comprising:

a floor having a length and a first edge between first and second corners, a second edge between third and fourth corners, a width and a centerline equidistant between the first and second corners and equidistant between the third and fourth corners;

a first interior wall having a height corresponding to the height of the end wall of the end module, the interior wall integrally formed with the first edge of the floor between the centerline and the second corner, the end wall having a width corresponding to half of the width of the floor;

a second interior wall having a height corresponding to the height of the end wall of the end module, the second interior wall integrally formed with the second edge of the interior module floor between the centerline and fourth corner and parallel to the first interior wall, the second interior wall having a width equal to half of the width of the floor; and wherein a plurality of end modules and interior modules may be combined to form a 3-dimensional, scalable plurality of rooms.

2. The manufactured components for modular building construction of claim 1 wherein each floor has integral steel reinforcement oriented parallel to the length of the floor, and the end wall, the interior wall and the first and second walls have integral steel reinforcement oriented parallel to the height of the walls.

3. The manufactured components for modular building construction of claim 1 wherein substantially all of the modules are formed of reinforced concrete.

4. A building formed using the manufactured components for modular building construction of claim 1.

5. The building of claim 4 wherein each floor of plurality of manufactured components has integral steel reinforcement oriented parallel to the length of the floor, and the end wall, the interior wall and the first and second walls of the plurality of manufactured components have integral steel reinforcement oriented parallel to the height of the walls.

6. The building of claim 4 wherein substantially all of the manufactured components are formed of reinforced concrete.

7. A method for forming scalable modular buildings comprising the steps:

providing a plurality of manufactured components for modular construction according to claim 1;

orienting a first and second end modules and n number of interior modules with their floors coplanar;

engaging a first edge of a first interior module of the n number of interior modules to the second edge of the first end module;

engaging the first edge of a second interior module of the n number of interior modules to the second edge of the first interior module;

engaging the first edge of an n interior module of the n number of interior modules to a second edge of an n−1 interior module;

engaging the first edge of the second end module to the second edge of the n interior module of the n number of interior modules to complete a row of spaces;

stacking rows of spaces as required to form a stack of spaces;

orienting stacks of spaces together to form a scalable modular building.

8. The method of claim 7 wherein each floor of plurality of manufactured components has integral steel reinforcement oriented parallel to the length of the floor, and the end wall, the interior wall and the first and second walls of the plurality of manufactured components have integral steel reinforcement oriented parallel to the height of the walls.

9. The building of claim 7 wherein substantially all of the manufactured components are formed of reinforced concrete.

* * * * *